US008482224B2

(12) United States Patent
De Hollan

(10) Patent No.: US 8,482,224 B2
(45) Date of Patent: Jul. 9, 2013

(54) LIGHT EMITTING APPARATUS

(75) Inventor: Aurel N. De Hollan, Vista, CA (US)

(73) Assignee: KVD Company, Inc., Carlsbad, CA (US)

( * ) Notice: Subject to any disclaimer, the term of this patent is extended or adjusted under 35 U.S.C. 154(b) by 370 days.

(21) Appl. No.: 13/005,864

(22) Filed: Jan. 13, 2011

(65) Prior Publication Data

US 2012/0181932 A1 Jul. 19, 2012

(51) Int. Cl.
*H05B 37/00* (2006.01)

(52) U.S. Cl.
USPC ..... 315/307; 315/185 R; 315/192

(58) Field of Classification Search
USPC ..... 315/185 R, 193, 192, 186, 224, 291, 315/307, 308
See application file for complete search history.

(56) References Cited

U.S. PATENT DOCUMENTS

| | | | | |
|---|---|---|---|---|
| 6,249,088 | B1 * | 6/2001 | Chang | 315/185 R |
| 7,288,902 | B1 * | 10/2007 | Melanson | 315/291 |
| 2008/0297059 | A1 * | 12/2008 | Nisani et al. | 315/185 R |
| 2009/0179589 | A1 * | 7/2009 | Buhler et al. | 315/297 |
| 2011/0309757 | A1 * | 12/2011 | Weaver et al. | 315/188 |

* cited by examiner

*Primary Examiner* — David H Vu
(74) *Attorney, Agent, or Firm* — WPAT, P.C.; Anthony King

(57) ABSTRACT

A light emitting apparatus comprises a light source array, a diffuser, and a control module. The diffuser is located below the light source for providing the simulated solar light to a test plane. The control module is configured for controlling driving voltages of the light source array. The emission spectrum of the light emitting apparatus complies with a predetermined standard, and the light source array is divided into a plurality of light groups with different wavelength bands according to the predetermined standard. The light groups in the light source array are composed of a plurality of light rows connected in parallel, and each light row of the light group is composed of a plurality of light emitting diodes (LEDs) and a resistor connected in series.

23 Claims, 4 Drawing Sheets

LIGHT EMITTING APPARATUS

BACKGROUND OF THE INVENTION (A) Field of the Invention

The present disclosure relates to a light emitting apparatus for generating simulated solar light.

(B) Description of the Related Art

With the increasing demands for limited energy resources in recent years, use of solar energy is becoming more and more popular. A solar cell can convert photo energy from sunlight directly into clean energy without causing negative environmental impacts. To obtain electric power, solar cells are generally installed on a roof or wall of a house which is accessible to sunlight.

In order to measure the performance of a solar cell, a step of evaluating the characteristics of the solar cell, especially the current-voltage characteristics, is required. The evaluating step generally uses a so-called solar simulator as a light source for evaluating the characteristics of the solar cells, instead of actual sunlight. The solar simulator radiates the artificial light of equalized radiance on the test plane of the solar cells in panel form and thus measures the current-voltage characteristics of the solar cell.

Solar simulator technology has developed for decades, and a variety of products are on the market. However, most of them are fabricated by a xenon lamp, and the common disadvantages of such products are short lifespan and high cost. A prior art solar simulator combines an incandescent lamp and a xenon lamp as a light source, and the simulated light is implemented by filtering infrared light of the incandescent lamp with a filter plate and incorporating infrared light of the xenon lamp. Spectral distribution of the simulated light with such combination is similar to that of actual solar light. However, the structure of this solar simulator is complicated, and the xenon lamp has short lifespan, high power consumption and high price, limiting the benefits of its use.

Therefore, there is a need to provide a light emitting apparatus for generating simulated solar light and reconstructing solar spectral distribution accurately.

SUMMARY OF THE INVENTION

One aspect of the present disclosure provides a light emitting apparatus for generating simulated solar light. The light emitting apparatus comprises a light source array, a diffuser, and a control module. The diffuser is located below the light source for providing the simulated solar light to a test plane. The control module is configured for controlling driving voltages of the light source array. The emission spectrum of the light emitting apparatus complies with a predetermined standard, and the light source array is divided into a plurality of light groups with different wavelength bands according to the predetermined standard. The light groups in the light source array are composed of a plurality of light rows connected in parallel, wherein each light row of the light group is composed of a plurality of light emitting diodes (LEDs) and a resistor connected in series.

The foregoing has outlined rather broadly the features and technical advantages of the present disclosure in order that the detailed description of the invention that follows may be better understood. Additional features and advantages of the invention will be described hereinafter, and form the subject of the claims of the invention. It should be appreciated by those skilled in the art that the conception and specific embodiment disclosed might be readily utilized as a basis for modifying or designing other structures or processes for carrying out the same purposes of the present disclosure. It should also be realized by those skilled in the art that such equivalent constructions do not depart from the spirit and scope of the invention as set forth in the appended claims.

BRIEF DESCRIPTION OF THE DRAWINGS

The objectives and advantages of the present disclosure will become apparent upon reading the following description and upon reference to the accompanying drawings in which.

DETAILED DESCRIPTION OF THE INVENTION

Figure 1:
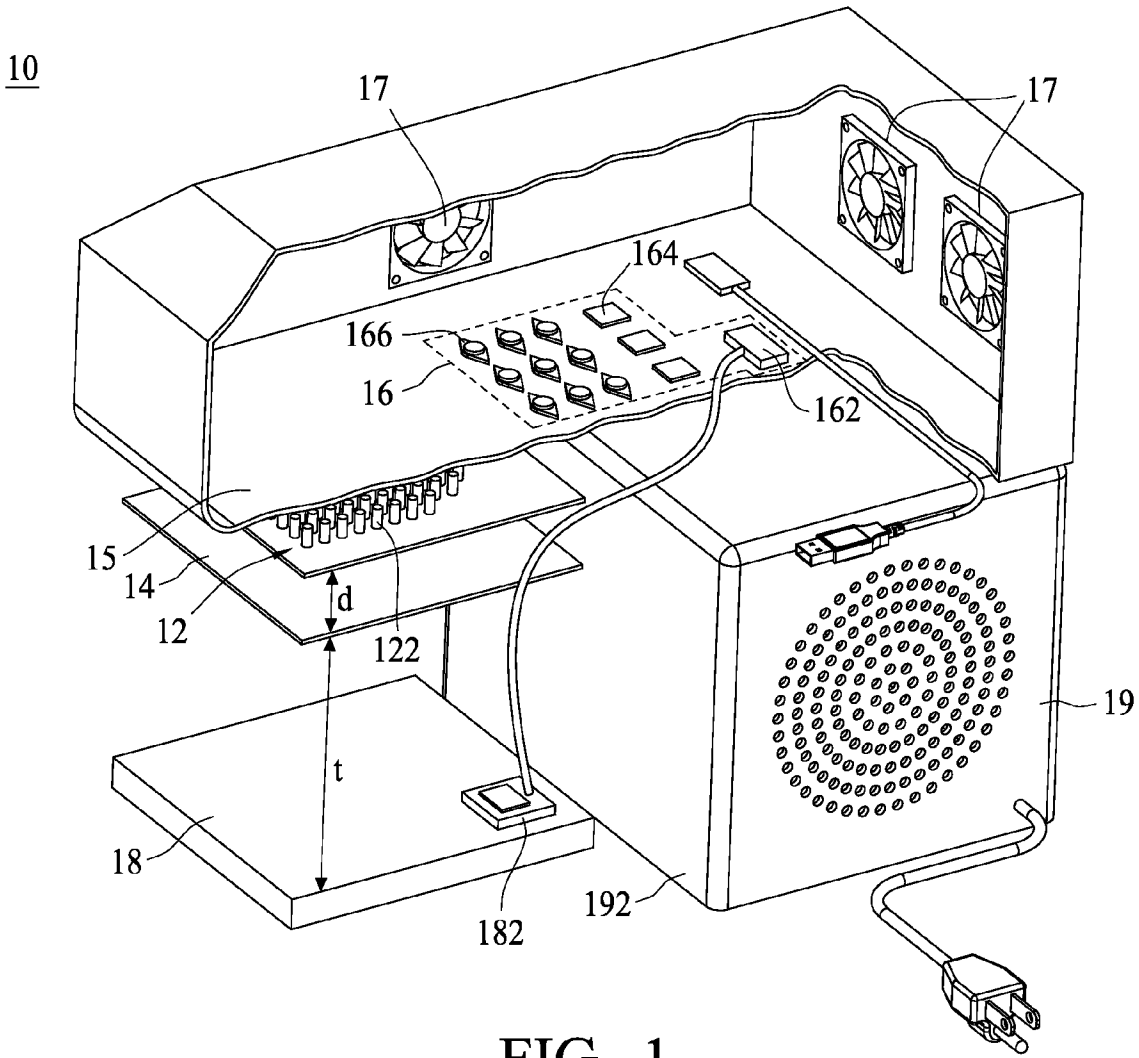
FIG. 1 shows a light emitting apparatus according to one embodiment of the present disclosure.

FIG. 1 shows a light emitting apparatus 10 according to one embodiment of the present disclosure. The light emitting apparatus 10 is configured to generate simulated solar light to a test plane 18. The light emitting apparatus 10 can be used either for measurements of the current-voltage characteristics of a photovoltaic device or for endurance irradiation tests. Referring to FIG. 1, the light emitting apparatus 10 comprises a light source array 12, a diffuser 14, and a control module 16. The light source array 12 is positioned on a printed circuit board (PCB) 15. The diffuser 14 is located below the light source array 12 for providing the simulated solar light, and the control module 16 is configured to control driving voltages of the light source array 12. The emission spectrum of the light emitting apparatus 10 complies with an international measurement standard, such as International Electrotechnical Commission (IEC)-60904, Japanese Industrial Standard (JIS) C 8192, or ASTM E927-10 Class A testing standards.

The light source array 12 is configured to generate a light source for providing simulated solar light. The light source array 12 comprises a plurality of light emitting diodes (LEDs) 122 with a variety of wavelength bands. Due to their low power consumption, high brightness, small volume and long lifespan, LEDs have become widely applied in the lighting field. While the prior-art solar simulator is composed of a single light source, if the present embodiment solar simulator includes light sources formed with various kinds of LEDs based on a predetermined standard, such as IEC-60904 standard, the LEDs require a specific arrangement. Because each kind of LEDs has different spectral distribution and emission strength, space distribution and spectral distribution of different kinds of LEDs are required to comply with the irradiance distribution of the standards. In addition, LEDs can be easily arranged in an array type, and the size of the array can be varied with the requirements. Therefore, the emission area of the light source array 12 can be enlarged, and the irradiance and the uniformity of the light source array 12 can be enhanced in such arrangement.

Referring to FIG. 1, the diffuser 14 is located directly below the light source array 12. The diffuser 14 is configured to disperse light emitted from the light source array 12 for providing uniform light to the test plane 18. The spatial uniformity in illumination can be improved by the diffuser 14. The diffuser 14 can be made from a translucent plastic material, frosted glass or holographic film. As shown in FIG. 1, a distance d is between the light source array 12 and the diffuser 14, and a distance t is between the diffuser 14 and the test plane 18. An increase in the distance d+t results in the improvement of spatial uniformity provided that the radiant power of the LEDs in the light source array 12 is sufficient. In addition, because the irradiance decreases in proportion to the square of the distance from a point source, the increase in the distance d or distance t results in the reduction of the irradiance. As a result, the actual distance t between the diffuser 14 and the test plane 18 and the actual distance d between the light source array 12 and the diffuser 14 are determined according to the required spatial uniformity and the required irradiance at the test plane 18.

Figure 2:
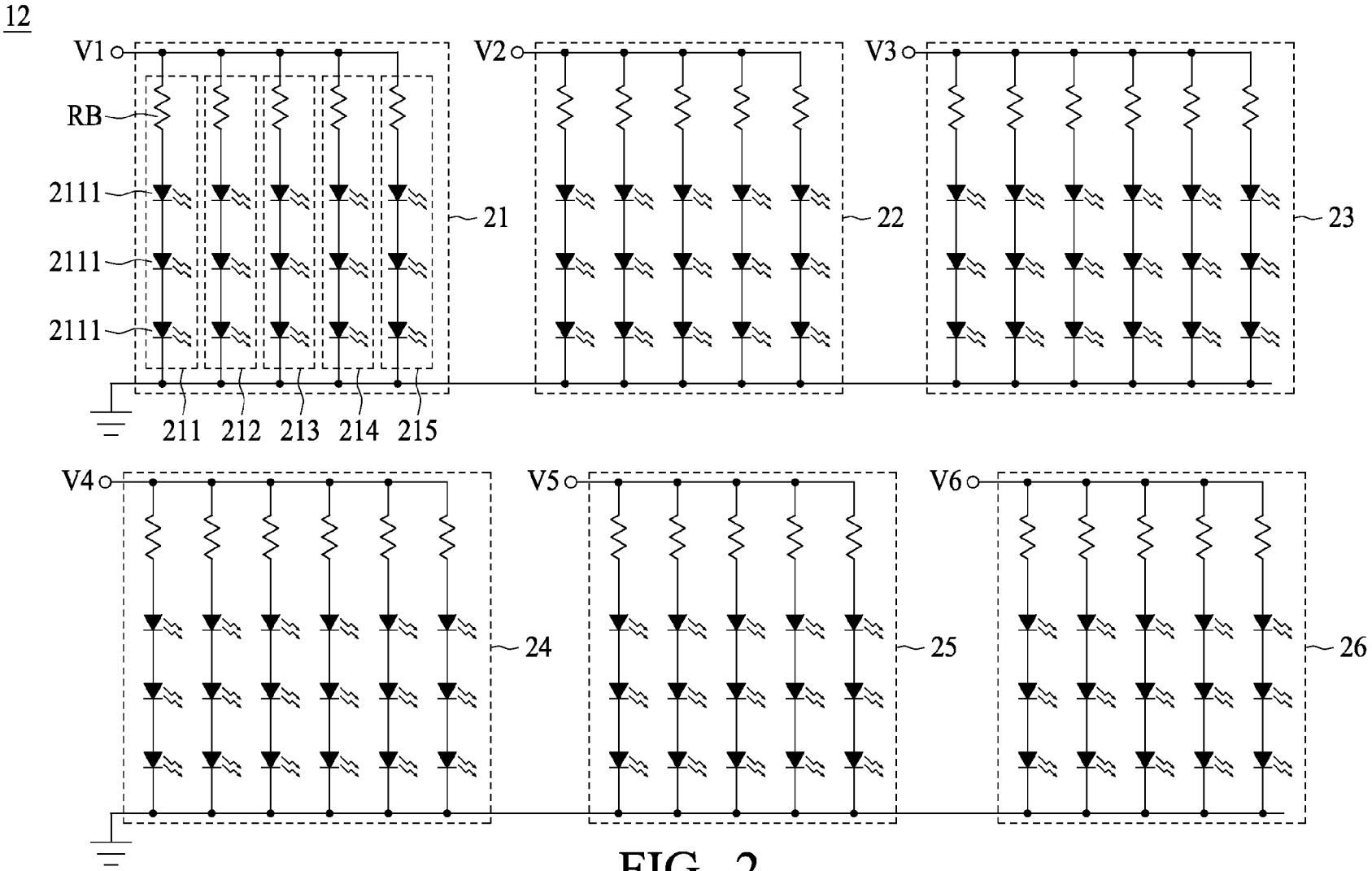
FIG. 2 shows an arrangement of the light source array according to one embodiment of the present disclosure.

Referring to FIG. 2, the light source array 12 is divided into a plurality of light groups 21 to 26, each having a specific wavelength band. In one embodiment of the present disclosure, the emission spectrum of the light source array 12 is designed to comply with the IEC-904-9 standard, and thus the light source array 12 is divided into six light groups. Table 1 shows energy distribution of reference solar radiation given in IEC-904-9.

TABLE 1

| i | Wavelength nm ($\lambda_i$ to $\lambda_{i+1}$) | Energy distribution % |
|---|---|---|
| 1 | 400 to 500 | 18.5 |
| 2 | 500 to 600 | 20.1 |
| 3 | 600 to 700 | 18.3 |
| 4 | 700 to 800 | 14.8 |
| 5 | 800 to 900 | 12.2 |
| 6 | 900 to 1100 | 16.1 |

As shown in Table 1, a solar simulator emits light with a sufficient illumination at a specific wavelength band. In order to meet the measurement of spectral match in this standard, the light source array 12 comprises a first light group 21 with a wavelength band between 400 and 500 nm, a second light group 22 with a wavelength band between 500 and 600 nm, a third light group 23 with a wavelength band between 600 and 700 nm, a fourth light group 24 with a wavelength band between 700 and 800 nm, a fifth light group 25 with a wavelength band between 800 and 900 nm, and a sixth light group 26 with a wavelength band between 900 and 1100 nm.

Referring to FIG. 2, each light group in the light source array 12 is composed of a plurality of light rows connected in parallel. For example, the light group 21 is composed of five light rows 211 to 215 connected in parallel. Each light row 211 to 215 of the light group 21 is composed of three LEDs 2111 and a resistor RB connected in series. The ballast resistor RB is designed to balance the current flowing through the rows 211 to 215 of the light group 21.

In addition, the number of the LEDs in each light group 21 to 26 is determined according to the required irradiance on the test plane 18, power loss of the diffuser 14, a safety factor multiplier, and the maximum radiant power of a single LED. For example, in order to generate an irradiance of 1000 W/m$^2$ on the test plane 18 having an area of 100 mm×100 mm from the second light group 22 with the wavelength band between 500 and 600 nm, since up to 85% of the radiant energy emitted by the light source array 12 will be lost due to the absorption of energy in the diffuser 14 and due to the redundant energy outside the test plane, the required radiant power provided by the light group 22 is 13.1 W, or preferably 16.4 W by considering an additional 25% safety factor. Because the maximum radiant power of a single LED is 0.4 W in one example, the second light group 22 requires at least 41 LEDs to provide the required irradiance on the test plane 18.

Referring to FIG. 1, a switching power supply 19 is configured to receive an alternating current (AC) with voltage between 100V and 240V from an electrical wall outlet. The switching power supply 19 shown in FIG. 1 commonly is referred to as a "forward" converter, which converts the AC signal to multiple direct current (DC) outputs. In one embodiment of the present disclosure, the switching power supply 19 is designed to generate an output voltage of 12V DC. By applying the 12V DC output to the control module 16, the light rows 211 to 215 in the light group 21 can comprise at least three serially connected LEDs, and thus the uniformity in light output of the light source array 12 can be improved and the power consumption of the control module 16 can be reduced. In addition, for providing sufficient irradiance on the test plane 18, the light source array 12 consumes a relatively large power. For example, in order to generate an irradiance of 1000 W/m$^2$ on the test plane 18 having an area of 100 mm×100 mm, the current consumption of the light source array 12 is about 15 A at 12V DC supply voltage. Therefore, multiple switching power supplies 19 may be required when the area of the illuminated surface becomes larger. In this case, each switching power supply provides power to a subset of the light groups in the light source array 12 through the control module 16.

Figure 3:
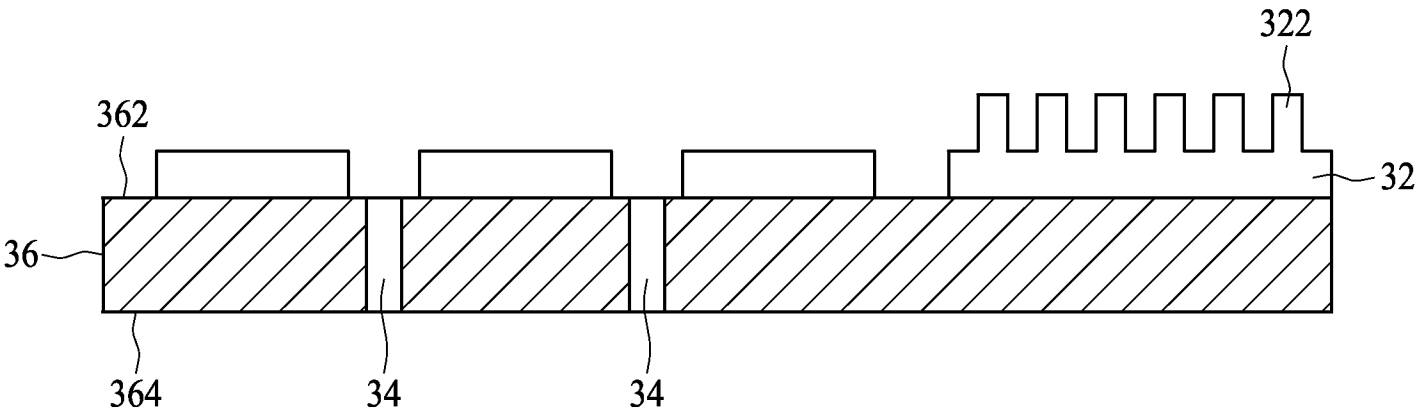
FIG. 3 shows a cross-sectional view illustrating a structure to conduct heat in accordance with one embodiment of the present invention.

Referring to FIG. 1, the switching power supply 19 is enclosed in the case 192. In order to conduct heat generated from the switching power supply 19, the case 192 is preferably made of metal. Because the power consumption of the switching power supply 19 may be up to 300 W, more heat dissipation methods are required for the switching power supply 19. In one embodiment of the present disclosure, at least one heat sink 32 having a heat dissipation fin 322 shown in FIG. 3 is positioned on a PCB 36 inside the case 192, and a plurality of vias 34 are formed to conduct heat from one surface 362 of the PCB 36 to the other surface 364. In another embodiment of the present disclosure, the heat is dissipated with airflow provided by at least one fan (not shown) inside the case 192.

In addition, the control module 16 and the light source array 12 also consume large amounts of power. Therefore, as shown in FIG. 1, at least one fan 17 is required to dissipate heat. The fan 17 is positioned adjacent to the top surface of the PCB 15 so as to remove the heat without undue light leaks. Furthermore, in one embodiment of the present disclosure, at least one heat sink (not shown) is positioned on the PCB 15 and a plurality of vias (not shown) are formed to conduct heat from one surface of the PCB 15 to the other surface. According to yet another embodiment of present invention, the light source array 12 and the control module 16 are positioned on different surfaces of the PCB 15 so as to distribute the heat.

Figure 4:
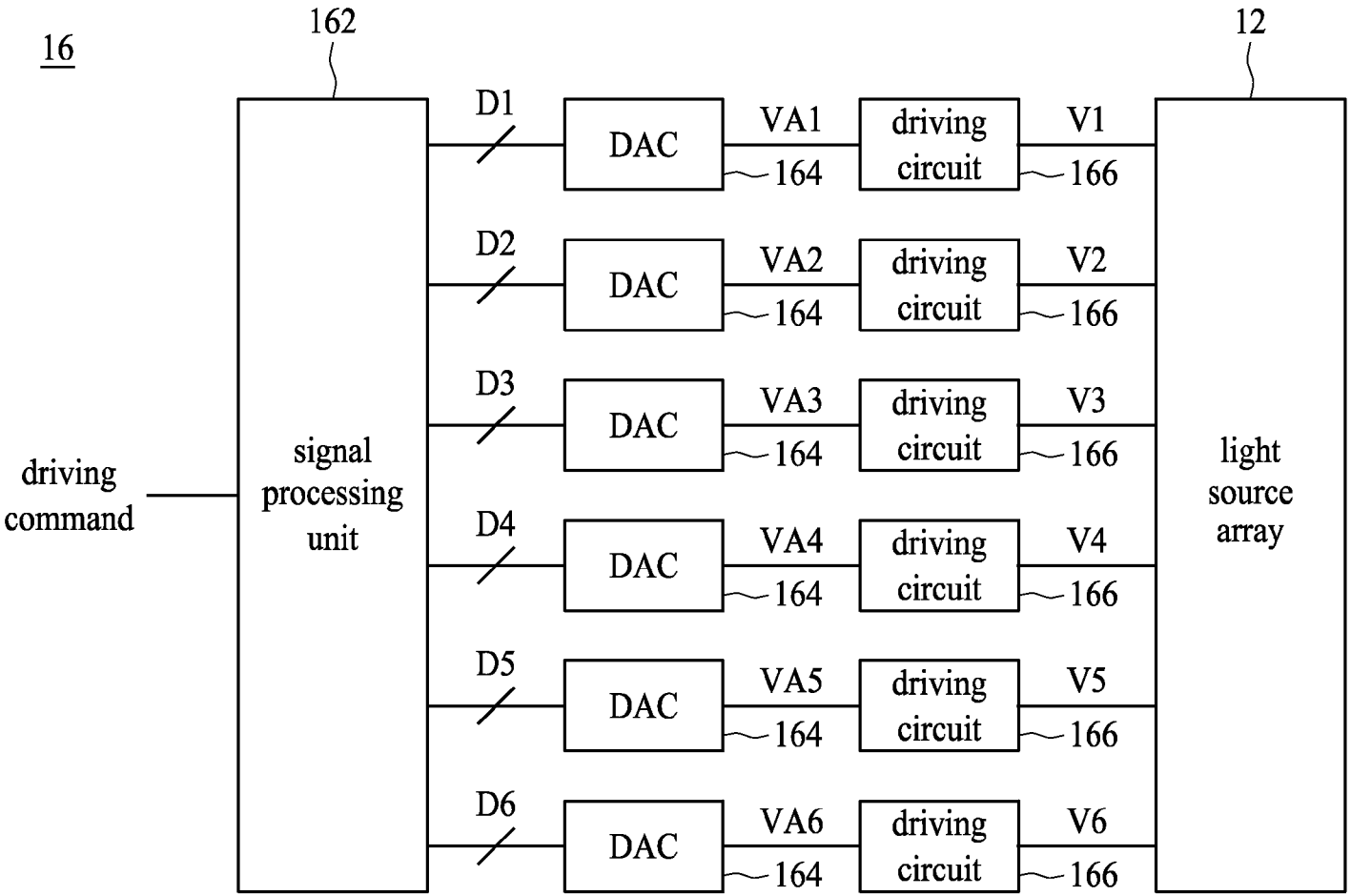
FIG. 4 illustrates a block diagram of the control module according to one embodiment of the present disclosure.

Referring to FIG. 1, the control module 16 comprises a signal processing unit 162, a plurality of digital-to-analog converter (DAC) circuits 164, and a plurality of driving circuits 166. FIG. 4 illustrates a block diagram of the control module 16 according to one embodiment of the present disclosure. Referring to FIG. 4, the signal processing unit 162 has an input for receiving a driving command, and has a plurality of outputs for generating a set of digital output words D1 to D6. The received driving command represents a solar spectrum in different conditions, such as in the evening or in the morning, or a required irradiance on the test plane 18. The plurality of DAC circuits 164 are connected to the outputs of the signal processing unit 162. Each of the DAC circuits 164 has an input for receiving the corresponding digital output word and has an output for generating an analog voltage corresponding to the digital output word. The digital output word represents the amplitude of the generated analog voltage. For example, for the 8 bit digital word 0000000, the analog voltage is set to 0V, and for the 8 bit digital word 11111111, the analog voltage is set to a full scale analog output value.

The plurality of driving circuits 166 are connected to the outputs of the DAC circuits 164. Each of the driving circuits 166 has an input for receiving the analog voltage from the corresponding DAC circuit and having an output for generating the driving voltage of the corresponding light group in the light source array 12. Therefore, according to the driving command, the signal processing unit 162 evaluates the values of the driving voltages applied to the light source array 12 and converts the values into a corresponding digital word. Subsequently, the DAC circuit 164 and the driving circuits send the driving voltage to the light source array 12 according to the corresponding digital word.

In one embodiment of the present disclosure, the driving voltages V1 to V6 of the light group 21 to 26 in the light source array 12 are determined according to the following equation:

$$V_i \times A_i \times P_i + B_i \times \log(P_i) + C_i \quad (1)$$

wherein $P_i$ is a required irradiance value of the light emitted from the $i^{th}$ light group, $V_i$ is a driving voltage applied to the $i^{th}$ light group, and $A_i$, $B_i$, and $C_i$ are constant coefficients for the $i^{th}$ light group.

For example, if an irradiance of 1000 W/m$^2$ on the test plane 18 having an area of 100 mm×100 mm is required, since the percentage of total irradiance in the wavelength band 500 to 600 nm is 20.1% (see Table 1), the irradiance at the test plane 18 provided by the second light group 22 is 2.01 W. In this case, assuming 90% of the emitted radiant power does not reach the test plane 18, if there are two light rows in light group 22, the radiant power emitted by each light row is about 10.05 W. Substituting Pi=10.05 into equation (1), the driving voltage V2 applied to the light group 22 can be obtained.

Referring to FIG. 4, the driving voltage V2 is generated by the driving circuit 166, which can be a linear regulator or a switching regulator. In operation, the signal processing unit 162 receives the driving command, which requests generation of an irradiance of 1000 W/m$^2$ on the test plane 18. Next, the signal processing unit 162 evaluates the values of the driving voltages V1 to V6 applied to the light groups 21 to 26, respectively, and converts the values into a set of digital word D1 to D6 according to the IEC 60904-3 standard. The DAC circuits 164 receive the set of digital words D1 to D6 and generates analog voltages VA1 to VA6 corresponding to the digital words D1 to D6. Finally, the driving circuits 166 receive the analog voltages VA1 to VA6 and generate the driving voltages V1 to V6 of the light groups 21 to 26 in the light source array 12.

In one embodiment of the present disclosure, the coefficients $A_i$, $B_i$, and $C_i$ are determined in a calibration mode. When the light emitting apparatus 10 operates in the calibration mode, three different voltages are applied to each light group in the light source array 12 and three different irradiance values are measured by the light sensor 182 attached to the test plane 18. In this manner, coefficients $A_i$, $B_i$, and $C_i$ in the $i^{th}$ light group can be calculated. In operation, a voltage $V_i$ is increased slowly until the irradiance is measured by the light sensor 182. In this situation, the voltage $V_i$ and the irradiance $P_i$ are measured and substituted into equation (1) as a first condition. Then, the voltage $V_i$ is increased continuously until the irradiance measured by the light sensor 182 is about 0.1 of the maximum irradiance value. In this situation, the voltage $V_i$ and the irradiance $P_i$ are measured and substituted into equation (1) as a second condition. Finally, the voltage $V_i$ increases to a value at which the maximum irradiance value is measured. In this situation, the voltage $V_i$ and the irradiance $P_i$ are measured and substituted into equation (1) as a third condition. Therefore, coefficients $A_i$, $B_i$, and $C_i$ in the $i^{th}$ light group can be calculated for three known voltages $V_i$ and irradiance $P_i$.

In one embodiment of the present disclosure, the coefficient $C_i$ is a temperature coefficient and is modified to $(C_i+\Delta V_f)$ for temperature variation. In order to obtain the parameter $\Delta V_f$, a voltage $V_{mi}$ applied to the $i^{th}$ light group is calculated first according to equation (1), wherein a small value of the irradiance $P_i$, for example 10W/m$^2$, is substituted into equation (1).

Therefore, $\Delta V_f$ can be obtained according to the following equation:

$$V_{mi} = A_i \times P_{i2} + B_i \times \log(P_{i2}) + (C_i + \Delta V_f) \quad (2)$$

wherein the coefficients $A_i$, $B_i$ and $C_i$ are determined in the calculation mode as mentioned above, and $P_{i2}$ is a measured irradiance value of the light emitted from the ith light group.

In one embodiment of the present disclosure, the irradiance $P_i$ also varies with the temperature and is modified to $P_i \times (1+0.005\Delta T_i)$ for temperature variation. $\Delta T_i$ can be obtained according to the following equation:

$$\Delta T_j = \Delta V_f / K \quad (3)$$

wherein k is a constant coefficient, typically around −3 mV/° C.

Therefore, since $\Delta V_f$ is obtained according to equation (2), $\Delta T_i$ can be obtained by substituting the value of $\Delta V_f$ into equation (3). After calculating the values of $\Delta V_f$ and $\Delta T_j$, the final driving voltage $V_{di}$ applied to the $i^{th}$ light group can be obtained according to the following equation, and the control module 16 is designed to generate the final voltage $V_{fi}$ with temperature compensation:

$$V_{di} = A_i \times P_i \times (1+0.005\Delta T_j) + B_i \times \log(P_i(1+0.005\Delta T_j)) + (C_i + \Delta V_F) \quad (4)$$

Although the present disclosure and its advantages have been described in detail, it should be understood that various changes, substitutions and alterations can be made herein without departing from the spirit and scope of the invention as defined by the appended claims. For example, many of the processes discussed above can be implemented in different methodologies and replaced by other processes, or a combination thereof.

Moreover, the scope of the present application is not intended to be limited to the particular embodiments of the process, machine, manufacture, composition of matter, means, methods and steps described in the specification. As one of ordinary skill in the art will readily appreciate from the description of the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. A light emitting apparatus for generating simulated solar light, comprising:

a light source array;

a diffuser located below the light source for providing the simulated solar light to a test plane; and a control module for controlling driving voltages of the light source array;

wherein the emission spectrum of the light emitting apparatus complies with a predetermined standard, and the light source array is divided into a plurality of light groups with different wavelength bands according to the predetermined standard; and wherein the light groups in the light source array are composed of a plurality of light rows connected in parallel, and each light row of the light group is composed of a plurality of light emitting diodes (LEDs) and a resistor connected in series.

2. The light emitting apparatus of claim 1, wherein the light source array comprises a first light group with a first wavelength band, a second light group with a second wavelength band, a third light group with a third wavelength band, a fourth light group with a fourth wavelength band, a fifth light group with a fifth wavelength band, and a sixth light group with a sixth wavelength band.

3. The light emitting apparatus of claim 1, further comprising:

a signal processing unit having an input for receiving a driving command, and having a plurality of outputs for generating a set of digital output words;

a plurality of digital-to-analog converter (DAC) circuits each having an input for receiving the corresponding digital output word and having an output for generating an analog voltage corresponding to the digital input word; and a plurality of driving circuits each having an input for receiving the analog voltage from the corresponding DAC circuit and having an output for generating the driving voltage of the corresponding light group in the light source array.

4. The light emitting apparatus of claim 1, wherein the driving command is a solar spectrum in different conditions or a required irradiance value on the test plane.

5. The light emitting apparatus of claim 1, wherein the digital output word is generated according to the required irradiance value on the test plane, the number of the light row in each light group, and the energy distribution defined by the predetermined standard.

6. The light emitting apparatus of claim 1, wherein the number of the LEDs in each light group is determined according to the required irradiance value on the test plane, power loss of the diffuser, and the maximum radiant power of a single LED.

7. The light emitting apparatus of claim 1, wherein the distance from the light source array to the diffuser and the distance from the diffuser to the test plane are determined according to the required spatial uniformity and the required irradiance value at the test plane.

8. The light emitting apparatus of claim 2, wherein the driving circuit is a linear regulator or a switching regulator.

9. The light emitting apparatus of claim 1, wherein the driving voltage of the light group in the light source array is determined according to the following equation:

$$V_i=A_i\times P_i+B_i\times\log(P_i)+C_i$$

wherein $P_i$ is a required irradiance value of the light emitted from the $i^{th}$ light group, $V_i$ is a driving voltage applied to the $i^{th}$ light group, and $A_i$, $B_i$, and $C_i$ are constant coefficients for the $i^{th}$ light group.

10. The light emitting apparatus of claim 9, wherein the coefficients $A_i$, $B_i$, and $C_i$ are determined by applying three voltages on the $i^{th}$ light group and measuring three irradiance values on the test plane in a calibration mode.

11. The light emitting apparatus of claim 10, wherein the irradiance values on the test plane are measured by a light sensor attached to the test plane.

12. The light emitting apparatus of claim 1, wherein the driving voltage of the light group in the light source array is determined according to the following equation:

$$V_i=A_i\times P_i\times\alpha_i+B_i\times\log(P_i\times\alpha_i)+(C_i+\beta_i)$$

wherein $P_i$ is a required irradiance value of the light emitted from the $i^{th}$ light group, $V_i$ is a driving voltage applied to the $i^{th}$ light group, $A_i$, $B_i$ and $C_i$ are constant coefficients for the $i^{th}$ light group, and $\alpha_i$ and $\beta_i$ are temperature coefficients for the $i^{th}$ light group.

13. The light emitting apparatus of claim 12, wherein the coefficients $A_i$, $B_i$ and $C_i$ are determined in a calculation mode according to the following equation:

$$V_i=A_i\times P_{i1}+B_i\times\log(P_{i1})+C_i$$

wherein $V_i$ is a driving voltage applied to the $i^{th}$ light group, and $P_{i1}$ is a measured irradiance value of the light emitted from the $i^{th}$ light group.

14. The light emitting apparatus of claim 13, wherein the irradiance value is measured by a light sensor attached to the test plane.

15. The light emitting apparatus of claim 13, wherein $\beta_i$ is determined according to the following equation:

$$V_{mi}=A_i\times P_{i2}+B_i\times\log(P_{i2})+(C_i+\beta_i)$$

wherein $P_{i2}$ is a measured irradiance value of the light emitted from the $i^{th}$ light group, and $V_{mi}$ is a calculated value obtained by the following equation:

$$V_{mi}=A_i\times P_{i3}+\beta_i\times\log(P_{i3})+C_i$$

wherein $P_{i3}$ is a constant value less than a maximum irradiance value on the test plane.

16. The light emitting apparatus of claim 15, wherein $P_{i3}$ is a constant value about one-tenth of the maximum irradiance value on the test plane.

17. The light emitting apparatus of claim 15, wherein $\alpha_i$ is determined according to the following equation:

$$\alpha_i=1+k\times\beta_i$$

wherein k is a constant coefficient.

18. The light emitting apparatus of claim 1, further comprising a power supply having an input for receiving an AC voltage and having an output for generating a DC voltage to supply to the control module.

19. The light emitting apparatus of claim 18, wherein the generated DC voltage is about 12V, and each light group in the light source array is composed of three LEDs connected in series.

20. The light emitting apparatus of claim 1, wherein the predetermined standard is IEC-60904, JIS C 8192, or ASTM E927-10 testing standard.

21. The light emitting apparatus of claim 1, wherein the light source array is positioned on a carrier, and a thermal fin is attached to the carrier and/or a plurality of vias are formed on the carrier to conduct heat.

22. The light emitting apparatus of claim 1, wherein the light source array is positioned on the top surface of a carrier, and the control module is positioned on the bottom surface of the carrier.

23. The light emitting apparatus of claim 21, wherein the light source array is positioned on the top surface of a carrier and a fan is positioned adjacent to the top surface of the carrier.

* * * * *